US005538048A

United States Patent [19]

De Jager

[11] Patent Number: 5,538,048

[45] Date of Patent: Jul. 23, 1996

[54] SYSTEM AND METHOD FOR REGULATING THE CLOTH FELL POSITION IN A LOOM

[75] Inventor: Godert De Jager, Benglen, Switzerland

[73] Assignee: Sulzer Rüti AG, Winterthur, Switzerland

[21] Appl. No.: 409,383

[22] Filed: Mar. 23, 1995

Related U.S. Application Data

[63] Continuation-in-part of Ser. No. 168,606, Dec. 16, 1993, abandoned.

[30] Foreign Application Priority Data

Jan. 19, 1993 [EP] European Pat. Off. ..... 93810027

[51] Int. Cl.[6] ..... D03D 49/10; D03D 49/04

[52] U.S. Cl. ..... 139/99; 139/110

[58] Field of Search ..... 139/99, 110

[56] References Cited

U.S. PATENT DOCUMENTS 5,024,253 6/1991 Kawabata et al. .

FOREIGN PATENT DOCUMENTS 0117479 9/1984 European Pat. Off. .
0208366 1/1987 European Pat. Off. .
0376338 4/1990 European Pat. Off. .
0504110 9/1992 European Pat. Off. .
668997 2/1989 Switzerland .

*Primary Examiner*—Andy Falik
*Attorney, Agent, or Firm*—Townsend and Townsend and Crew

[57] ABSTRACT

A system and method for regulating the cloth fell position in a loom. The desired lengths of cloth and warp thread are determined by averaging the actual values over a given number of weft insertions. The actual lengths of the cloth and warp thread are then continuously measured and compared with the desired values during weaving to compute warp and cloth offset values. A correction factor is determined based on the offset values and the moduli of elasticity of the warp thread and cloth. The cloth fell position is then corrected by adjusting either the actual length of the cloth or the warp thread based on the correction factor.

15 Claims, 6 Drawing Sheets

SYSTEM AND METHOD FOR REGULATING THE CLOTH FELL POSITION IN A LOOM

BACKGROUND OF THE INVENTION

This application is a continuation-in-part of commonly assigned application Ser. No. 08/168,606, filed Dec. 16, 1993 abandoned. The present invention is directed to a method of regulating the cloth fell position with respect to the position of the sley in a loom and a loom for the performance of the method.

In order to avoid points of start in the fabric, various solutions have been proposed. One solution provides for the displacement of a breast beam arranged to be movable at constant warp thread tension in order to reset the position of the fell of the cloth after a stoppage of the loom. In another solution, in the case of alteration of the yarn density, the kind of weft yarn or the kind of warp yarn, the shift of the fell of the cloth is calculated with the aid of an input of new data and through control of the warp let-off and the cloth take-up to cancel out the shift of the fell of the cloth. A further solution provides, in the case of a stoppage of the loom, to cancel the shift of the fell of the cloth by reduction or reproduction of the warp thread tension.

SUMMARY OF THE INVENTION

The present invention solves the above described problems by continuously regulating the shifting of the fell of the cloth with respect to the position of reversal of the reed that is caused by the faulty behavior of the elements cooperating with the run of warp to cloth during operation of the loom.

In order to determine the shift of the fell of the cloth, the free length of run of warp to cloth and/or the measurement of the delivery of warp and/or cloth and/or the position of at least one element cooperating with the run of warp to cloth is measured in dependence upon the position of the main shaft. The operational behavior of the loom may thereby be incorporated into the method in an advantageous way. It further proves advantageous if the desired values for the measured systems are calculated from a mean value for K weft insertions, whereby a direct relationship may be achieved between the actual and desired values on the running loom.

BRIEF DESCRIPTION OF THE DRAWINGS

The invention is explained below with the aid of the attached drawings wherein.

DESCRIPTION OF THE PREFERRED EMBODIMENT

Figure 1:
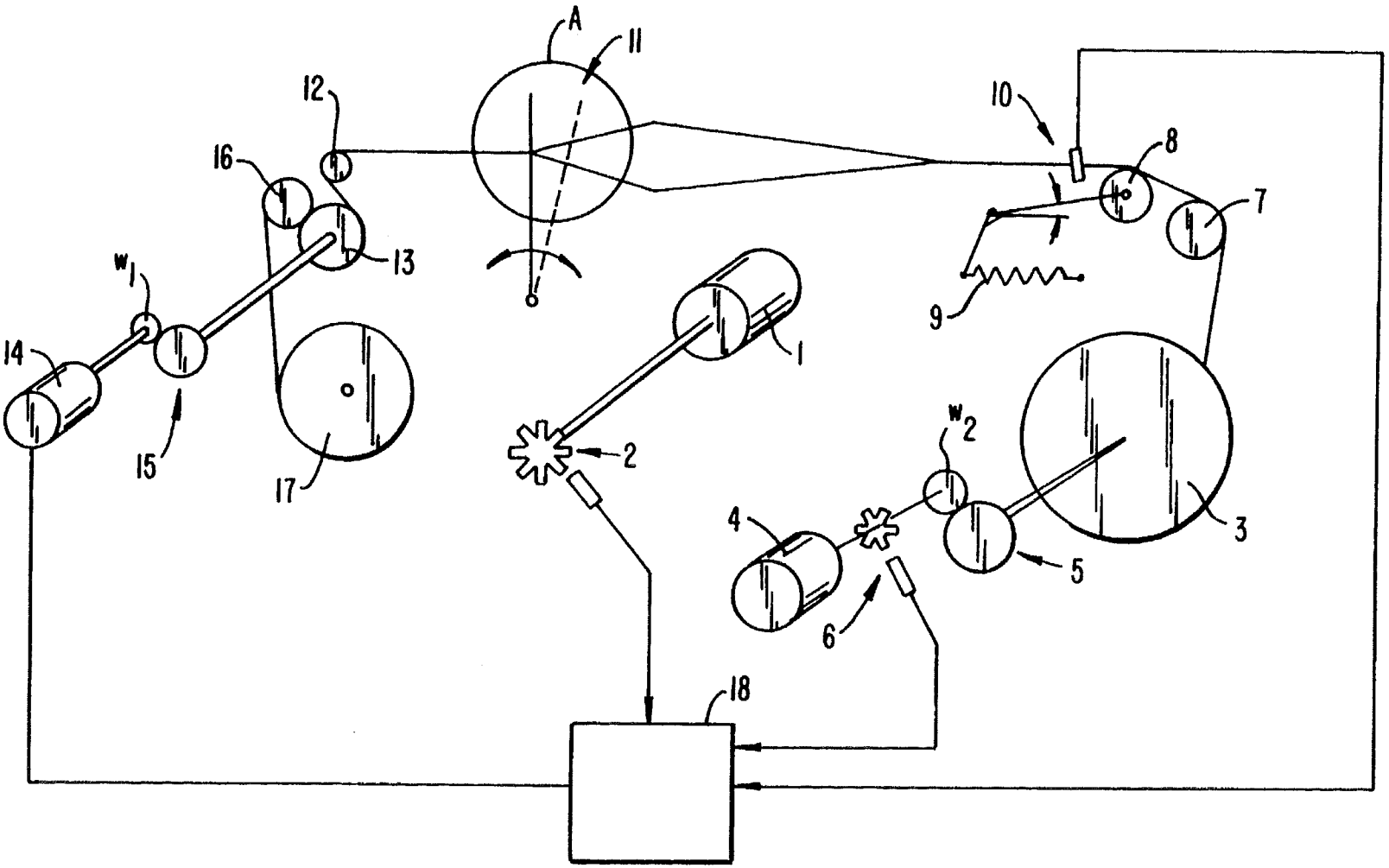
FIG. 1 is a diagrammatic view of a loom according to the present invention.

As shown in FIG. 1, the loom contains a main shaft 1 with a signal transmitter 2 for the angular position of rotation of the main shaft, a warp beam 3 which exhibits a driving mechanism 4 with a warp circuit 5 for the warp let-off and a signal transmitter 6 for the warp let-off position, a bearer beam 7, a tension beam 8 with a tension device 9 which is arranged to be movable in order to keep the warp thread tension constant, and a signal transmitter 10 for the position of the tension beam, a reed 11, a breast beam 12, a switch-beam 13 with a driving mechanism 14 and a cloth take-up circuit 15 for drawing off the cloth, a pressure roll 16 and a cloth beam 17 for winding up the cloth. A controller 18 is further provided, which is connected on one side to the signal transmitter 2 for the angle of rotation of the main shaft 1, the signal transmitter 6 for the warp let-off position and the signal transmitter 10 for the position of the tension beam, and on the other side to the driving mechanism 14 of the switch-beam 13.

Figure 2:
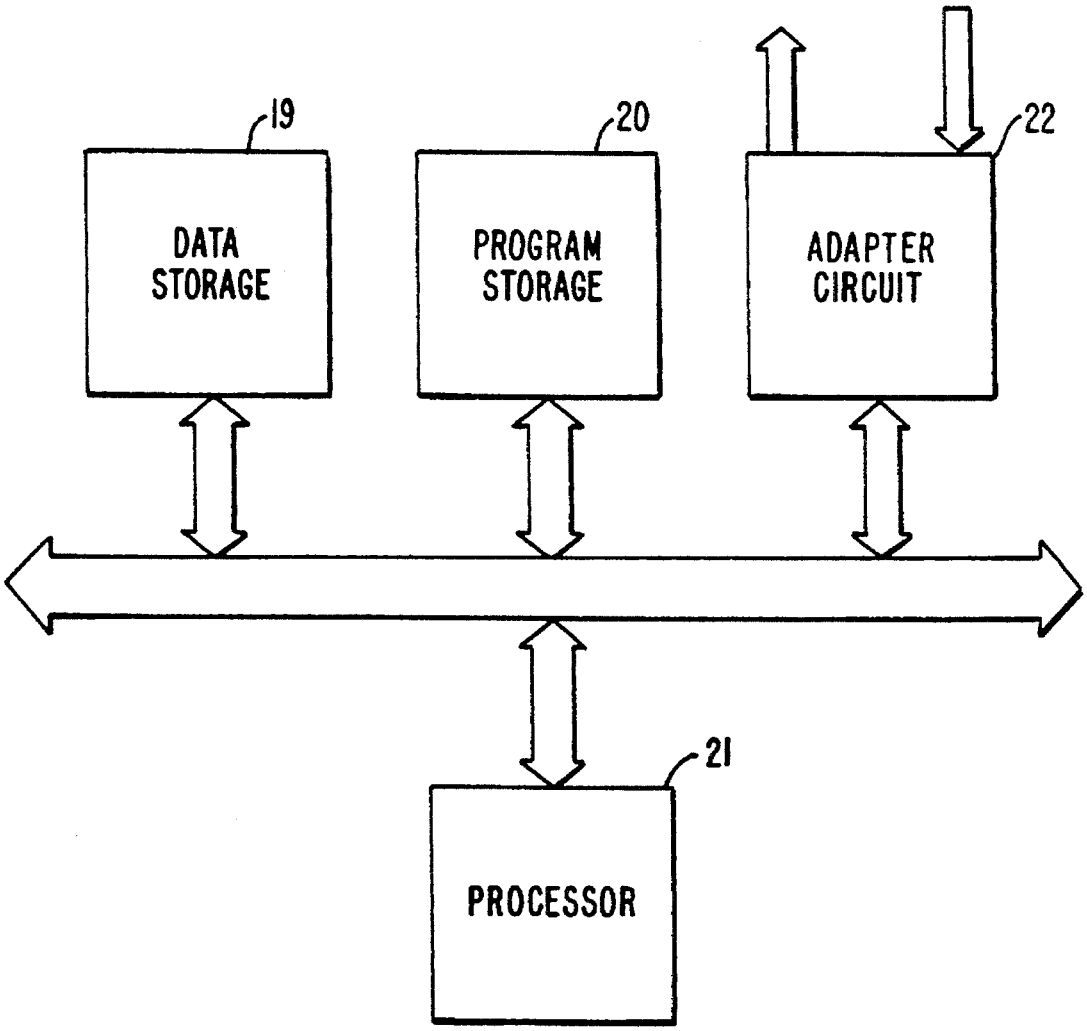
FIG. 2 is a block diagram of control equipment for the loom of FIG. 1.

One embodiment of the control equipment is represented in FIG. 2. The control equipment contains a data storage 19, a program storage 20 and a processor 21, which are operatively connected together via data leads on the one hand and to an adaptor circuit 22 on the other. The adaptor circuit 22 is in turn connected to the signal transmitters 2, 6 and 10 and to the cloth circuit 14.

Figure 3:
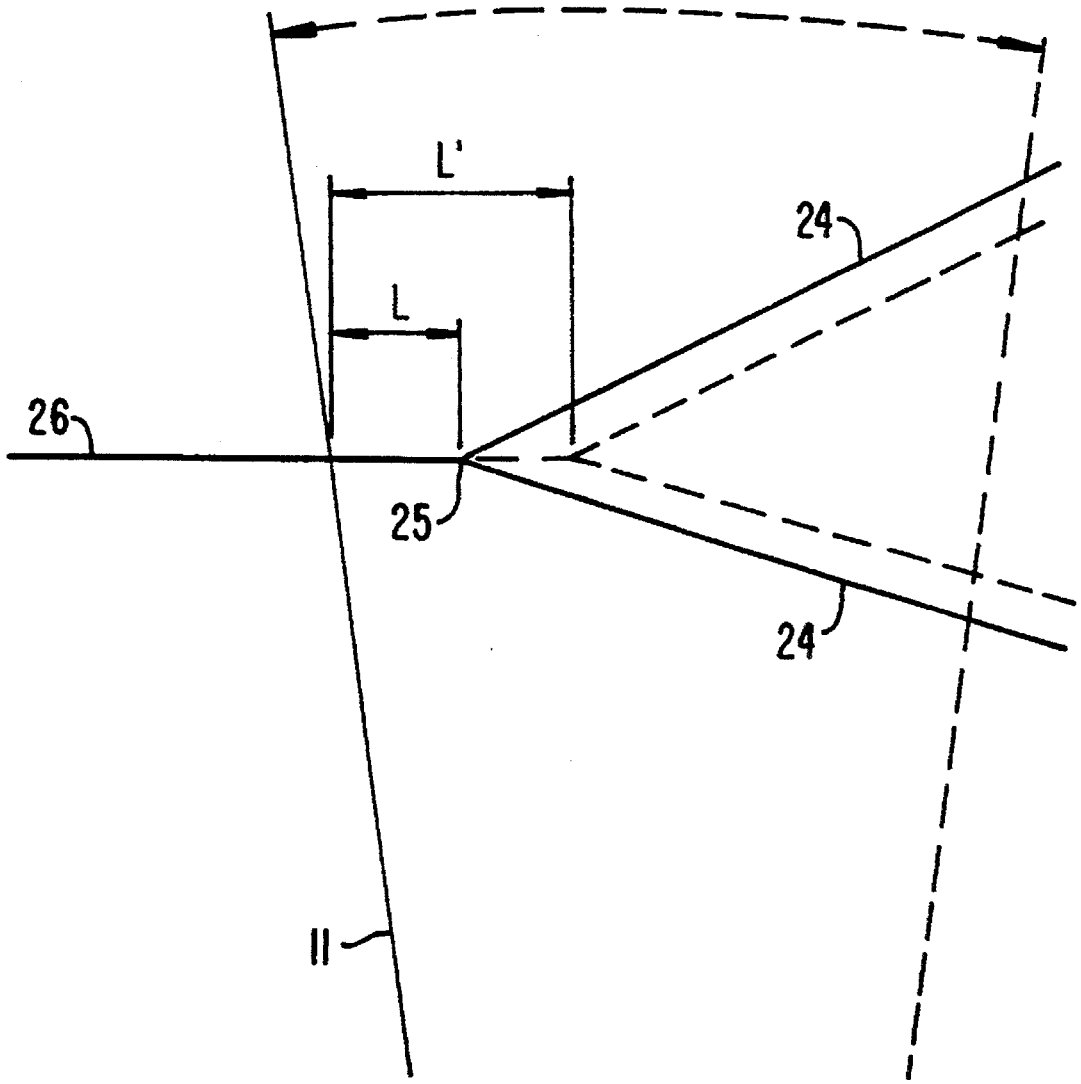
FIG. 3 is an enlarged view of the detail A of FIG. 1.

FIG. 3 is a diagrammatic representation of the region of the loom in which the actual weaving process takes place. In FIG. 3, the reed 11 is shown in the drawn back position by a dotted line and in the position of reversal by a solid line. The shed formed by the warp threads 24 turns at the fell of the cloth 25 into the cloth 26. The distance L between the fell of the cloth 25 and the reed 11, when lying in the position of reversal, represents the desired value which is regulated according to the method of the present invention. During operation of the loom, (as well as when it is at a standstill) the position of the fell of the cloth alters (due to unsteady behavior of the warp let-off and tension beam) so that between the shifted fell of the cloth 24 and the reed 11, when lying in the position of reversal, there is a distance L' which represents the actual value of the position of the fell of the cloth. The length of the shift in the fell of the cloth follows from the relationship L—L'.

Figure 4:
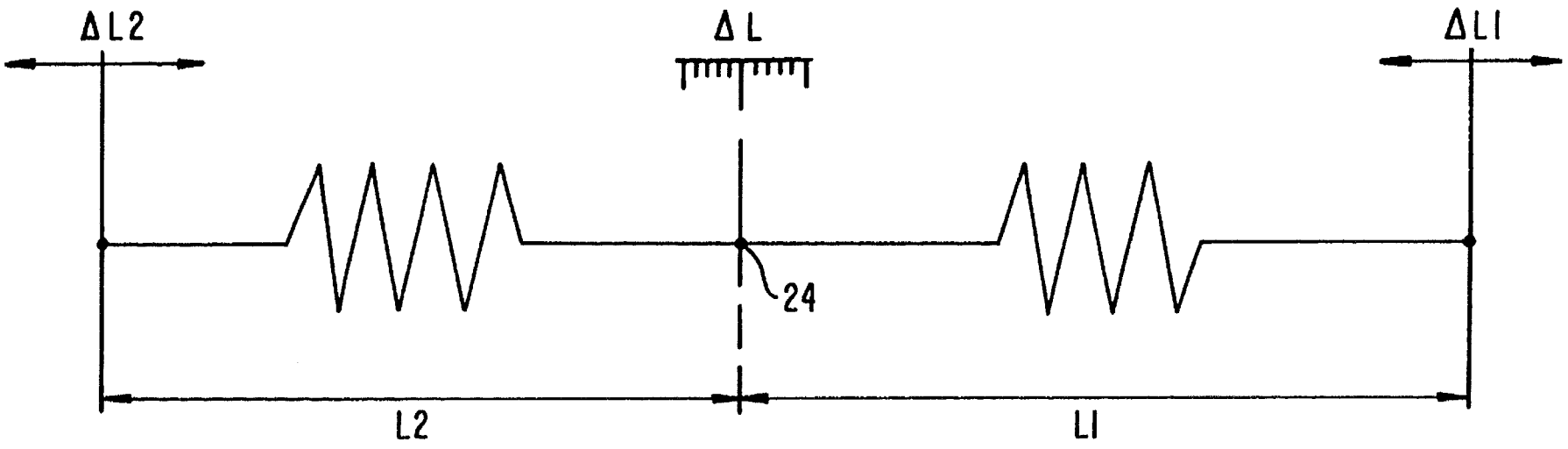
FIG. 4 is a diagrammatic representation of a feature in accordance with the invention.
Figure 5:
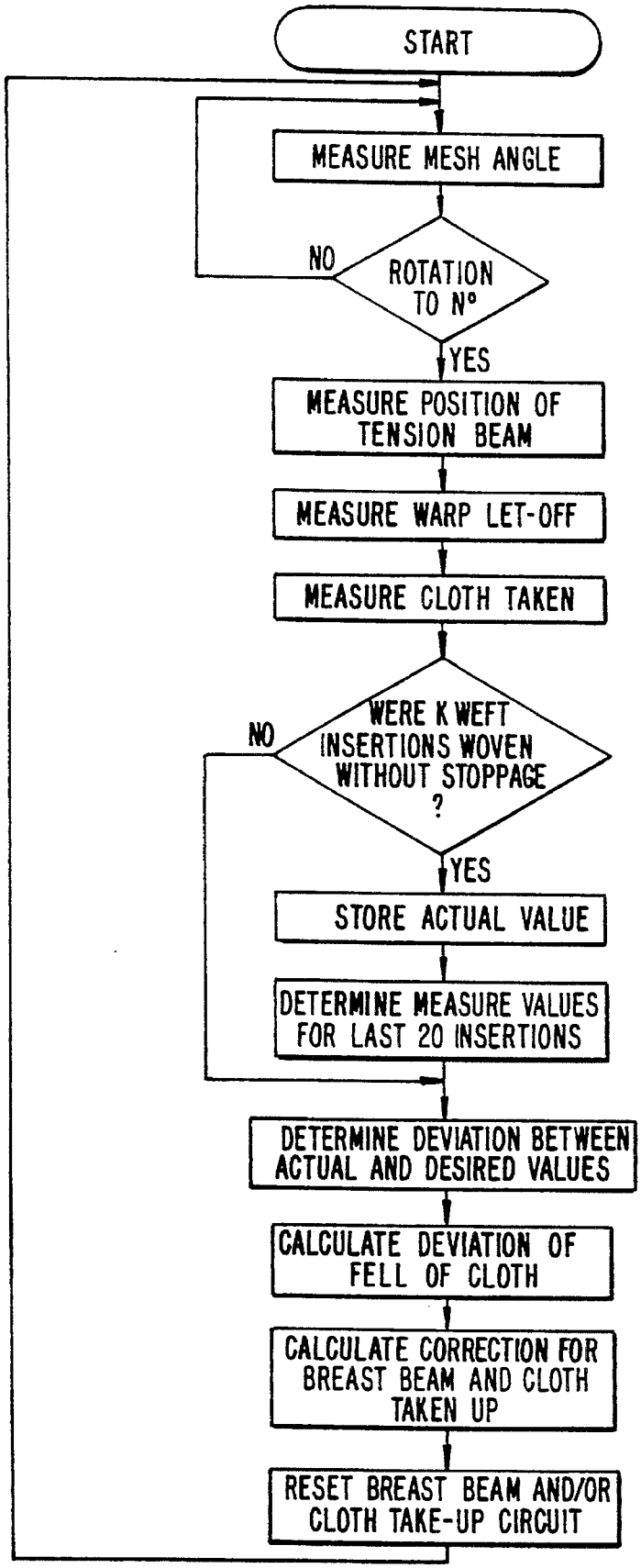
FIG. 5 is a flow diagram of the course of one form of execution of a method in accordance with the invention.

Referring to FIGS. 4 and 5, a form of execution of the method will now be described. Upon switching on the loom, the angular position of rotation of the main shaft (i.e., the mesh angle) is measured. The rotation of the main shaft 1 is then monitored. After the main shaft 1 has executed an angle of rotation of n°, e.g., 10°, the length let off by the warp beam, the position of the tension beam 8 and the cloth length wound up onto the cloth beam 17 are measured; for each revolution of the main shaft 1 the same number of measurements are provided. These measured values are actual values and are deposited in the fifo storage 19. These actual values are preferably determined through an optical sensor. From a number of weft insertions, e.g., 20 inclusive of the last weft insertion, average values of the measured values are determined, which are taken as desired values L1, L2 for the free length of cloth and warp. The deviation between the actual and desired values L1, L2 is then determined and the deviation of the fell of the cloth is determined (discussed in more detail below). Through this procedure, the operational behavior of the loom is taken into consideration in an advantageous way for the determination of these desired values L1 and L2.

The inventive method for calculating the deviation of the fell of the cloth will now be described. During weaving, the lengths of free warp and cloth alter. On the warp side, the lengths alter through the unsteady behavior of the warp let-off and tension beam 8. On the cloth side, the lengths alter through the unsteady behavior of the cloth take-up circuit. The length is specified by separation points C, D on warp beam 3 and cloth beam 17, respectively, (FIG. 4). The alterations in length ΔL1 and ΔL2 are determined with the aid of a comparison between the actual values and desired values. Since at the fell 25 of the cloth, that is, at the transition from warp to cloth, an equilibrium of force exists, the deviation ΔL of the free fell of the cloth is calculated from the ratio of the moduli of elasticity of the warp and cloth and the lengths L1, L2 of warp and cloth.

Figure 6:
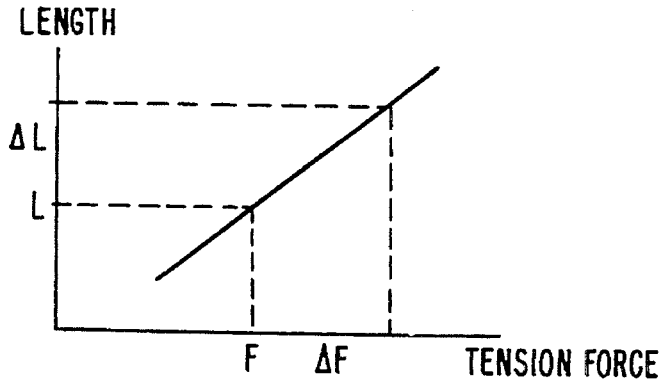
FIG. 6 is a graph of the elasticity constant.

It is well known that the elasticity modulus is the inverse value of the expansion value. The expansion value is the proportionality factor between expansion (length) and tension (force). Thus, the elasticity constant K equals ΔF×L/ΔL and from that ΔF=K×ΔL/L, as shown in FIG. 6.

Figure 7:
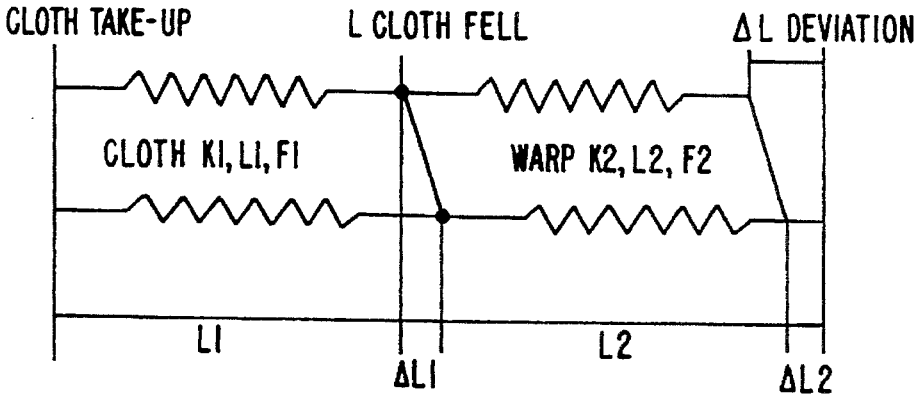
FIG. 7 is an example of the modulus of elasticity applied to looms according to the present invention.

Referring to FIG. 7, an example of the above theory of elasticity applied to looms will now be described. It should be noted that the following case is merely used to illustrate the invention and the invention is not intended to be limited in that manner. The terms in the following example mean:

K1 Elasticity constant of the cloth

K2 Elasticity constant of the warp

L1 Length of the cloth (from the cloth take up point to the cloth fell position)

L2 Warp length (from the cloth fell position to the separation line on the warp beam) is taken as a constant F1 Cloth force F2 Warp force In this example, the length deviations all and ΔL2 from the cloth fell position are very small relative to L1 and L2. As discussed above, a force equilibrium exists at the cloth fell position when an article (cloth and warp) is placed in the loom such that $$\Delta F1=\Delta F2.$$

From which is derived:

$$K1/L1\times\Delta L1=K2/L2\times\Delta L2$$

and further $$\Delta L2=K1/K2\times L2/L1\times\Delta L1.$$

During operation of the loom, a deviation in the position of the tension beam caused by friction and/or deviations in the behavior of the warp let-off results in forced length deviation $\Delta L_{dev}$, which is distributed in length deviations in the cloth ΔL1 and the warp ΔL2. From this it can be shown that $$\Delta L_{dev}=\Delta L1+\Delta L2$$

$$\Delta a_{dev}=\Delta L1+\Delta L1\times K1/K2\times L2/L1$$

Because L2 has been taken as a constant, the effective deviation of the cloth fell position is equal to ΔL1, i.e. $\Delta L_{cf}=\Delta L_{dev}\times[1/1(1+K1/K2\times L2/L1)]$(where $\Delta L_{cf}$ is the change in the cloth fell position and $\Delta L_{dev}$=L(deviation)).

On the basis of this model, the correction value for the length of run of warp to cloth is calculated repeatedly in the processor L1. It should be noted that other factors may be taken into account in determining the correction value, such as the number of warp threads removed during operation of the loom, a change of weave during operation of the loom and the like. In the case of the present embodiment the correction value is calculated for the cloth side. The position of the breast beam 12 and/or of the cloth take-up circuit 15 is then adjusted accordingly to move the cloth fell 25 to the desired value L1.

Figure 8:
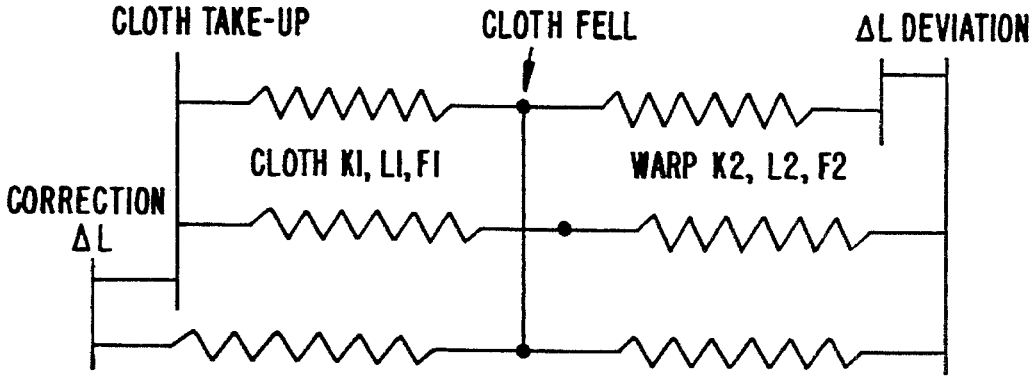
FIG. 8 is an example illustrating correction of the cloth fell position after applying the example of FIG. 7.

To correct the cloth fell position, $\Delta L_{cf}$ can be balanced by adjusting the cloth length, $\Delta L_{corr}$, as shown in FIG. 8. In the corrected state, the entire change in the length of the warp is equal to the force length deviation $\Delta L_{dev}$. The required correction is based on the force equilibrium. $\Delta L_{corr}$ is replaced with all and $\Delta L_{dev}$ is replaced with L2.
From this:

$$\Delta L_{corr}=\Delta L_{dev}$$

The correction factor (k2/k1×L1/L2) has a constant value for a particular weave and for the adjustment of the weaving machine; in which k2/k1 is a function of the type of weave and the geometric configuration of the weaving machine. The correction factor on a weaving machine may be ascertained simply by making an adjustment in the warp let-off direction to $\Delta L_{dev}$ when the shed is closed, then measuring the distance $\Delta L_{corr}$ from the cloth take-up line about which the fell of the cloth is to be displaced, in order to attain the original position.

It is also possible to calculate the correction value for the warp side. In this case, the correction value for the warp let-off and/or the position of tension beam 8 is calculated and then the tension beam 8 and/or the warp let-off is adjusted accordingly to move the cloth fell into the desired value L2. Besides the possibilities name above, other elements in operative connection with the run from warp to cloth may also be set accordingly.

The described method is particularly useful if the loom is being taken into service again after a stoppage. Through the determination of the desired value with the loom running, the setting may be performed essentially on the basis of the arithmetical model. If the stoppage has been triggered through breakage of a weft yarn, the desired value may be corrected with respect to the weft yarn removed without additional outlay in apparatus technology. In determining the average value, the change of weave may also be taken into consideration.

What is claimed is:

1. A method of regulating a cloth fell position in a loom comprising the steps of:

computing a desired length of warp thread and a desired length of cloth;

during operation of the loom, measuring an actual length of warp thread and an actual length of cloth;

computing a warp offset value representing a difference between the desired length of warp thread and the actual length of warp thread and a cloth offset value representing a difference between the desired length of cloth and the actual length of cloth;

determining a correction value for the cloth fell position based on the warp and cloth offset values and the moduli of elasticity of the warp thread and the cloth; and correcting the cloth fell position based on the correction value.

2. The method of claim 1 wherein the correcting step includes correcting the actual length of cloth based on the correction value.

3. The method of claim 1 wherein the correcting step includes correcting the actual length of warp thread based on the correction value.

4. The method of claim 1 wherein the loom includes a tension beam for directing the warp thread towards the cloth fell position, the correcting step including changing a position of the tension beam to correct the actual length of warp thread.

5. The method of claim 1 wherein the loom includes a breast beam for winding the cloth from the cloth fell position, the correcting step including changing a position of the breast beam to correct the actual length of cloth.

6. The method of claim 1 wherein the computing step includes measuring a plurality of warp thread and cloth lengths over a given number of weft insertions, storing the plurality of warp thread and cloth lengths and computing average values for the warp thread and cloth lengths, the average values representing the desired lengths of warp thread and cloth.

7. The method of claim 6 wherein the average values are further based on a change of weave during operation of the loom.

8. The method of claim 1 wherein the correcting step includes optically sensing the actual cloth fell position.

9. The method of claim 1 wherein the correction value is further based on a number of warp threads removed during operation of the loom.

10. The method of claim 1 wherein the measuring, computing, determining and correcting steps are continuously repeated during operation of the loom to continuously correct the cloth fell position.

11. The method of claim 1 wherein the determining step includes computing a correction factor based on a ratio of the moduli of elasticities of the warp thread and the cloth and a ratio of the desired lengths of the warp thread and the cloth, the correction factor being constant for a given weave.

12. The method of claim 11 further including determining the correction value based on the correction factor and the warp and cloth offset values.

13. A method for regulating a cloth fell position in a loom comprising the steps of:

computing a desired length of warp thread from a warp beam to the cloth fell position and a desired length of cloth from the cloth fell position to a cloth take-up point;

determining a correction factor based on the desired lengths of warp thread and cloth and the moduli of elasticity of the warp thread and the cloth;

during weaving, continuously measuring an actual length of warp thread from the warp beam to the cloth fell position and an actual length of cloth from the cloth fell position to a cloth take-up circuit;

determining a deviation distance of the cloth fell position based on the correction factor and the actual lengths of warp thread and cloth; and correcting the cloth fell position based on the deviation distance.

14. A controller for regulating a cloth fell position position in a loom having a warp let-off where warp threads are introduced, a cloth take-up circuit where cloth is taken up from the loom and a tension beam for controlling a tension of the warp threads, the controller comprising:

sensors for measuring lengths of the warp thread and the cloth during operation of the loom;

a data storage means for storing the measured lengths of warp thread and cloth;

a program storage means for storing a desired length of warp thread and a desired length of cloth in the loom;

means for determining a warp offset value corresponding to the difference between the measured and desired lengths of warp thread and a cloth offset value corresponding to the difference between the measured and desired lengths of cloth;

means for computing a correction value for the cloth fell position based on the warp offset value, the cloth offset value and the moduli of elasticity of the warp thread and the cloth; and means for correcting the positions of one of the cloth take-up circuit, the warp let-off and the tension beam based on the correction value.

15. A system for controlling a cloth fell position in a loom having a warp let-off where warp threads are introduced, a cloth take-up circuit where cloth is taken up from the loom and a tension beam for controlling a tension of the warp threads, the system comprising:

drives for controlling positions of the cloth take-up circuit, warp let-off and tension beam;

sensors for measuring a length of warp thread and a length of cloth during operation of the loom;

a controller comprising an adaptor circuit coupled to the sensors for receiving the measured lengths of warp thread and cloth, a data storage means for storing the measured lengths of warp thread and cloth, a program storage means for storing a desired length of warp thread and a desired length of cloth in the loom, means for determining a warp offset value corresponding to the difference between the measured and desired lengths of warp thread and a cloth offset value corresponding to the difference between the measured and desired lengths of cloth and means for computing a correction value for the cloth fell position based on the warp offset value, the cloth offset value and the moduli of elasticity of the warp thread and the cloth; and wherein the positions of one of the cloth take-up circuit, the warp let-off and the tension beam are corrected based on the correction value.

* * * * *